US006277240B1

(12) United States Patent
Marcoccia et al.

(10) Patent No.: US 6,277,240 B1
(45) Date of Patent: Aug. 21, 2001

(54) METHOD FOR CONTINUOUSLY PULPING CELLULOSIC FIBROUS MATERIAL

(75) Inventors: Bruno S. Marcoccia, Queensbury; C. Bertil Stromberg, Glens Falls; Brian F. Greenwood, Queensbury, all of NY (US)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

(21) Appl. No.: 09/165,991

(22) Filed: Oct. 2, 1998

(51) Int. Cl.[7] ..... D21C 7/12

(52) U.S. Cl. ..... 162/17; 162/25; 162/37; 162/41

(58) Field of Search ..... 162/16, 17, 29, 162/37, 39, 45, 60, 25

(56) References Cited

U.S. PATENT DOCUMENTS

| | | | | |
|---|---|---|---|---|
| 4,780,181 | * | 10/1988 | Lind | 162/17 |
| 5,489,363 | | 2/1996 | Marcoccia et al. . | |
| 5,536,366 | | 7/1996 | Marcoccia et al. . | |
| 5,547,012 | | 8/1996 | Marcoccia et al. . | |
| 5,575,890 | | 11/1996 | Prough et al. . | |
| 5,620,562 | | 4/1997 | Marcoccia et al. . | |
| 5,662,775 | | 9/1997 | Marcoccia et al. . | |
| 5,885,414 | * | 3/1999 | Lindstrom et al. | 162/19 |

OTHER PUBLICATIONS

Marcoccia, B.S. "Lo–Solids. . . Applications", Tappi Journal, vol. 79, No. 6, pp. 179–188, Jun. 1996.*

* cited by examiner

*Primary Examiner*—Dean T. Nguyen
(74) *Attorney, Agent, or Firm*—Nixon & Vanderhye P.C.

(57) ABSTRACT

In the production of chemical pulp, such as kraft pulp, it is possible to reduce the amount of ancillary equipment, and/or the size of the continuous digester vessel, while achieving enhanced uniformity of treatment by avoiding "hang ups". Instead of providing vertical counter-current flow of liquid and comminuted cellulosic fibrous material being treated in the lower half of the digester, the counter-current flow may be a cross flow, that is substantially horizontal (e.g. radial) while the flow of the chip column is vertical. Regardless of the configuration of the digester vessel, a single pump may be utilized for all of the recirculations, or only a few pumps for all of the recirculations.

18 Claims, 4 Drawing Sheets

112
111
117
116
125
225
230
110
118
210
221
126
226
119
222
211
216
216'
127
214
227
120
223
212
229
218
231
215
121
217
219
124
228
220
128
214
122
213
224
113
114

METHOD FOR CONTINUOUSLY PULPING CELLULOSIC FIBROUS MATERIAL

BACKGROUND AND SUMMARY OF THE INVENTION

The pulping system described in U.S. Pat. Nos. 5,489,363; 5,536,366; 5,547,012; 5,575,890; 5,620,562; and 5,662,775 and marketed under the trademark LO-SOLIDS® pulping by Ahistrom Machinery Inc., of Glens Falls, N.Y., has revolutionized the art of chemical pulping. Among other things, the many manifestations of the LO-SOLIDS process has introduced a marked increase in the versatility of operating continuous pulping systems. However, in addition to the versatility that the LO-SOLIDS process provides for the pulping process, this process also introduces versatility to the cooking system and in particular to the vessels and other equipment associated with the pulping process.

It is well established that the counter-current flow of cooking liquors within a continuous digester vessel limits how much cellulose material can be processed in the vessel. In the treatment of comminuted cellulosic fibrous material in a vertical vessel, the driving force for the downward flow of material is gravity. The downward force of gravity is opposed by the buoyant force of the material in the liquid. The typically well-impregnated material is denser than the surrounding liquid and the material "sinks" in the vessel. However, the difference in density of the material and the surrounding liquor is not great; the difference in specific gravity between a typical fully-impregnated, gas-free wood chip and that of the surrounding liquid is only about 0.1 to 0.2. Thus any additional forces that tend to counter-act the force of gravity can interfere with the flow of material through the vessel.

One such force which opposes the downward flow is friction, specifically the friction imposed by the internal surfaces of the vessel. Screen assemblies through which liquid is removed from the material slurry provide a significant source of friction to the downward movement of the cellulose material. The typically lateral flow of liquid toward the annular screen assembly imposes a normal force on the screen assembly which locally increases the force of friction at the screen. If the friction force at the screen exceeds the downward force of the chips, the flow of chips can be hindered, or "hung up" on the screen assembly, with adverse consequences for uniformity of treatment.

Another force that acts upon the chip mass in a continuous digester (the chip mass is often referred to as the "chip column") is the viscose force of liquid flowing upward or downward in the chip column. Downward, or co-current, flowing liquids aid the force of gravity and promote the downward flow of material. Upward, or counter-current, flowing liquids counter-act the force of gravity. In extreme cases, the force of the upwardly flowing liquid can impede the downward flow of material.

The upward force on the chip column due to the upward flowing liquid is dependent upon the upward flow velocity of the liquid. The higher the flow velocity, the higher the resistance to downward flow and the more the resilient chip column is compacted. This compaction further impedes the upward flow of liquid. The flow velocity is dependent upon the production rate or the amount of cellulose material passing through the vessel per unit time. As the production rate increases the flow required to maintain an upward counter-current displacement of liquid increases. Typically, the resistance and compaction imposed by the counter-current flow of liquid limits how much production can be passed through the vessel. A point can be reached where the resistance and compaction caused by the upward flow of liquid overcomes the downward force of gravity and the downward flow of material is impeded or stopped entirely.

In one embodiment of this invention, this limitation upon the production rate that can be passed through a treatment vessel is substantially eliminated by substantially eliminating or minimizing the need for the counter-current flow of liquors within the chip column. In another embodiment of this invention the size of a continuous digester vessel can be reduced by eliminating the need for one or more counter-current treatments while still effecting the desired treatment of the pulp.

In conventional continuous digesters, the ratio of length, L, of a vessel to its diameter, D, typically varies between 7 and 9. However, using the present invention the design of continuous digesters is not limited to this conventional range of UD and vessels having larger or smaller L/D ratios may be used. This latitude in vessel dimension provides the designer much more flexibility in designing and constructing digester vessels specifically, and pulping systems in general.

The present invention can be used in situations where space is a limiting factor and a narrower, taller vessel is desired. Also, the present invention is advantageous when expanding the capacity of existing, typically older, narrower digesters where counter-current treatment is not possible or undesirable. The present invention is also advantageous when a wider vessel can be used, for example, when space is not a limiting factor. Again, according to the present invention, L/D ratios larger and smaller than are conventional can be used.

In addition, the present invention is also applicable to zones in a vessel that are production limited due to their geometry. Where the discussion above discusses the dimensions of a vessel as a whole, the present invention is also applicable to cylindrical treatment zones in the digester, for example cooking zones or washing zones, that are production limited or exhibit less than optimum treatment conditions due to their geometry. The production and treatment in these zones can be enhanced by introducing "cross-flow" treatment or by substituting cross-flow treatment for counter-current treatment.

Conventionally the control of temperature and chemical distribution throughout the height of a continuous digester requires that liquors be removed from the vessel by several screen assemblies, augmented with cooking or dilution liquor, and returned to the digester, typically after passing through a heat exchanger. Such typical liquor removal and recirculations are shown in published EP patent application 476,230 which discloses a process marketed by Ahlstrom Machinery under the name EMCC® cooking, or in the US patents identified above for LO-SOLIDS cooking. However, these liquor removal and re-introduction circulations typically require individual pumps and heat exchangers as shown in these patents and the published EP patent application. Typically, the increased process versatility provided by these processes also require additional equipment, in particular additional pumps and heat exchangers. However, the unique features of LO-SOLIDS pulping, in which multiple extractions of cooking liquor having a high concentration of dissolved organic material and replacement of the cooking liquor with fresh cooking liquor and liquor having a lower concentration of dissolved organic material, provides the opportunity of reducing the number of pumps, heat exchangers and other equipment, required to continuously produce chemical pulp.

This is especially true since the liquids introduced to the cooking circulations in the LO-SOLIDS process are relatively uniform in composition. Where in conventional processes the concentration of cooking chemical and the concentration of dissolved material introduced at multiple locations typically varies significantly, the concentration of liquids introduced at two or more locations using the LO-SOLIDS process may be fairly uniform. For example, the liquid introduced at two or more locations in the LO-SOLIDS process may typically have a dissolved solids concentration of 60–80 g/l and an effective alkali (EA) of 12–20 g/l (as NaOH). Thus, using a single pump and associated equipment to distribute these two or more streams of liquid becomes particularly viable when employing the LO-SOLIDS process.

One embodiment of this invention comprises or consists of a method and apparatus for treating comminuted cellulosic fibrous material in which the production rate is not limited by the counter-current flow of liquid during treatment. According to this aspect of the invention a method of treating comminuted cellulosic fibrous material (such as wood chips) in a substantially upright vessel (such as a continuous digester) is provided. The method comprises substantially continuously: (a) feeding a liquid slurry of comminuted cellulosic fibrous material into a top portion of the vessel; (b) withdrawing treated comminuted cellulosic fibrous material from a bottom portion of the vessel, so that the comminuted cellulosic fibrous material moves substantially continuously downwardly in the vessel; and (c) in substantially the lower half of the vessel, causing treating liquid to flow substantially horizontally into and out of contact with the comminuted cellulosic fibrous material as the comminuted cellulosic fibrous material flows downwardly in the vessel, to effect treatment of the comminuted cellulosic fibrous material substantially without interfering with the substantially continuously downward movement of the comminuted cellulosic fibrous material (i.e. so that there are substantially no vertical counter-current zones).

Preferably (c) is practiced using at least one screen assembly at a peripheral portion of the vessel, and by introducing treating liquid into a central portion of the vessel at the approximate level of the or each screen assembly, and withdrawing the majority of the liquid introduced at the approximate level of the or any screen assembly through that screen assembly. Also step (c) may be practiced at a plurality of vertically spaced screen assemblies, and (c) is typically further practiced using cooking liquor (such as kraft cooking liquor like white liquor) as the treating liquid at at least one of the screen assemblies (and as many as all), and (c) may also be further practiced by recirculating liquid withdrawn from one screen assembly as introduced treating liquid at a central portion of another screen assembly (such as the immediately above screen assembly). Also (c) may be practiced by using one or more screen assemblies during or after the cellulose material is exposed to cooking temperature, e.g. 140° C. or greater.

The method may further comprise (d) augmenting the flow of liquid introduced at at least one central portion with a non-cooking liquor having a dissolved organic material concentration less than ½ (desirably substantially zero) that of the dissolved organic material concentration of the liquid withdrawn through the screen assembly associated with that central portion. For example (d) may be practiced using washer filtrate.

In the preferred embodiment the vessel is substantially cylindrical and has an L/D ratio (the length or height to the width or diameter, in the case of a circular cylindrical vessel, the diameter outside the ratio 7–9 to 1); and (c) may be practiced by causing the treating liquid to flow substantially radially in the vessel. (c) may be practiced at two, three or more vertically spaced locations along the substantially upright vessel and using a cooking liquor as the treatment liquor at at least two of the locations. (c) may also be further practiced by recirculating radially flowing liquid at one location as introduced induction liquid at another location, such as the immediately vertically above location.

According to another aspect of the invention an apparatus for treating comminuted cellulosic fibrous material is provided. The apparatus comprises the following components: A substantially upright vessel having a top and a bottom, a length or height L, a maximum width or diameter D, an upper half, and a lower half. An inlet for a liquid slurry of comminuted cellulosic fibrous material adjacent the top of the vessel. An outlet for a treated liquid slurry of comminuted cellulosic fibrous material adjacent the bottom of the vessel. At least first and second vertically spaced screen assemblies disposed within the vessel. At least first and second liquid introducing structures disposed at the approximate vertical level of each of the screen assemblies which introduce treating liquid that is ultimately withdrawn through the first and second screen assemblies, respectively. The UD ratio is preferably outside the range of 7–9 to 1, e.g. about 10 to 1 or greater, or about 6 to 1 or less. The vessel is substantially devoid of internal counter-current flow between materials and fluids (particularly liquids) in substantially the lower half of the vessel.

Preferably the vessel comprises a continuous digester, and also preferably it is substantially cylindrical. The vessel may have one or more step outs along its length, or it may also have no step outs, and may have at most one step out.

The first screen preferably is above the second screen and the apparatus further comprises means for recirculating liquid withdrawn from the second screen to the second liquid introducing structure. Liquid introducing structures may be open-ended or perforated along their length, such as in conventional digesters, or any other suitable conventional structure capable of properly introducing liquid. The at least first and second screens may comprise at least first, second, third and fourth screens, and preferably the at least first and second liquid introducing structures comprise at least first, second, third and fourth liquid introducing structures. The apparatus may further comprise liquid recirculating means for recirculating liquid from at least another screen besides the second screen to another liquid introducing structure besides the first liquid introducing structure.

The second, third or fourth screen may also be below the first screen. For instance, the first screen may include a circulation and some of the liquid may be removed from the circulation and directed to a lower screen circulation. For example, the first screen may be associated with a cooking or heating circulation in the upper part of the digester and the second screen may be an extraction screen below the first screen. The liquid from the upper circulation, containing, for example, an EA of 15–20 g/l, may be introduced to the vicinity of the extraction screen in, what is termed in the art, the "quench circulation" associated with the extraction screen.

Another embodiment of this invention comprises or consists of a method and apparatus for treating comminuted cellulosic fibrous material in which the number of pumps and other equipment required is reduced compared to conventional systems. In the broadest embodiment of this invention at least two circulations for a continuous digesters are handled by a single pump. According to this embodiment of the invention a continuous digester is provided comprising the following components: A substantially upright continuous digester vessel having a top and a bottom. An inlet for a liquid slurry of comminuted cellulosic fibrous material adjacent the top of the vessel. An outlet for a treated liquid slurry of comminuted cellulosic fibrous material adjacent the bottom of the vessel. At least first and second vertically spaced screen assemblies disposed within the vessel. At least first and second liquid introducing structures which introduce treating liquid that is ultimately withdrawn through the first and second screen assemblies, respectively. Recirculating means for recirculating liquid from the screen assemblies to the liquid introducing structures. And wherein the recirculating means comprises a single pump common to both the first and second screen assemblies and liquid introducing structures.

It is a primary object of the present invention to provide a simplified yet more effective chemical (e.g. kraft) pulp producing method and/or apparatus. This and other objects of the invention will become clear from an inspection of the detailed description of the invention, and from the appended claims.

DETAILED DESCRIPTION OF THE DRAWINGS

Figure 1:
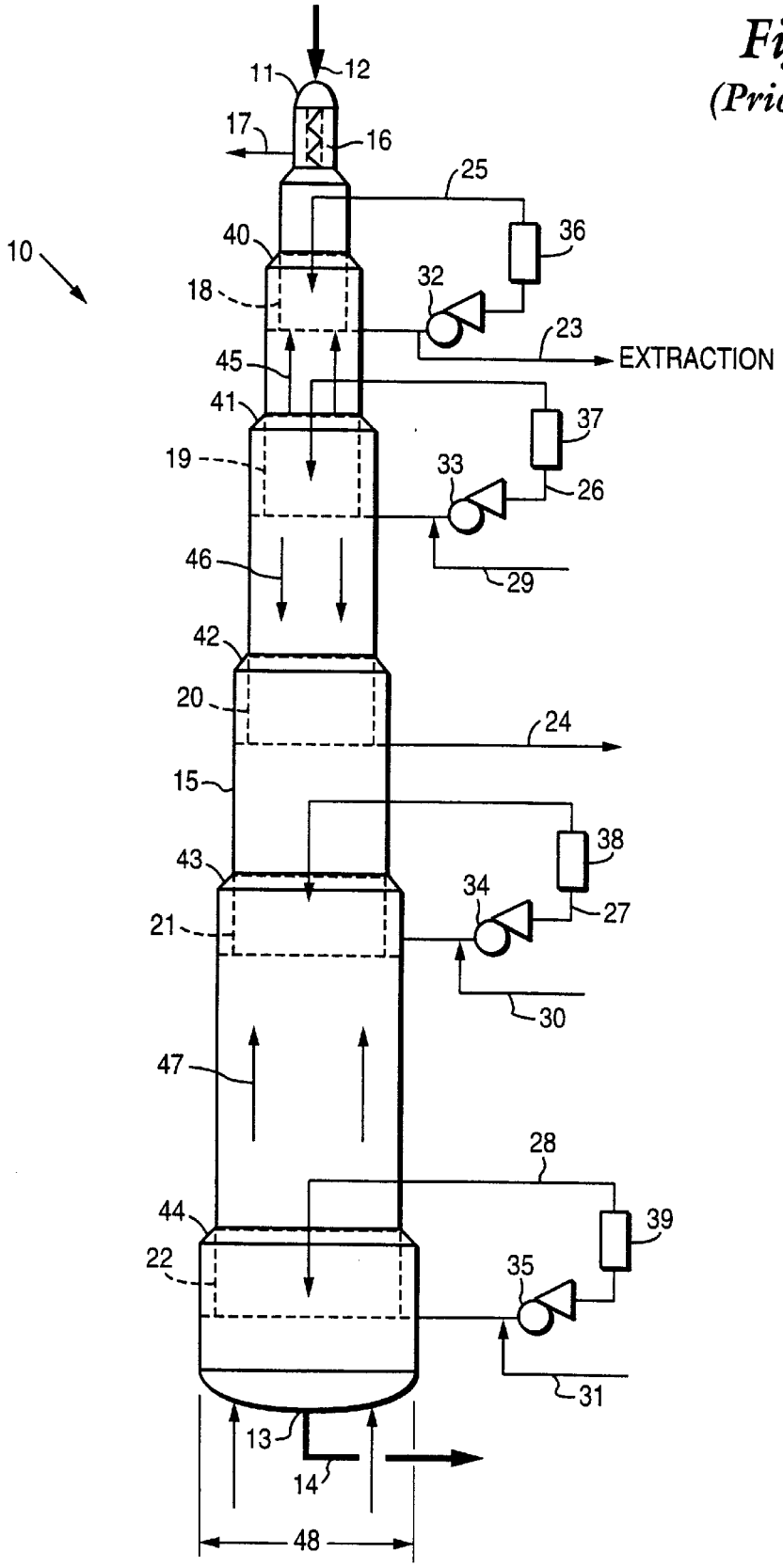
Fig. 1 (Prior Art)
FIG. 1 is a schematic illustration of a typical prior art continuous digester over which the present invention is an improvement.

FIG. 1 illustrates a typical prior art continuous digester 10. The digester 10 includes a substantially upright cylindrical vessel 15 with a pulp inlet 11 adjacent the top for receiving a slurry 12 of comminuted cellulosic fibrous material (e.g. wood chips) and liquor, and an outlet 13 adjacent the bottom thereof for essentially fully pulped material 14. The L (length or height)/D (width or maximum diameter) ratio thereof is typically between about 7–9 to 1. The inlet 11 typically includes a liquor separator 16, for example a Top Separator, for removing excess liquor from the slurry 12 in line 17. Screen assemblies 18, 19, 20, 21, and 22 are provided for removing liquor from the slurry passing through the vessel 15, and either extracting or recirculating it. Extraction is shown at 23, 24; the extracted liquor is used elsewhere or treated to recover cooking chemical. Liquor that is recirculated is recirculated by recirculation loops, such as 25, 26, 27, or 28. The recirculated liquor may be augmented by the addition of fresh cooking liquor, dilution liquor, liquor containing a strength or yield-enhancing additive such as anthraquinone or polysulfide or their derivatives or equivalents, for example, as shown at 29, 30 or 31.

As is typical of the prior art systems, the motive forces for the recirculations, 25 through 28, are typically provided by a plurality of centrifugal pumps 32, 33, 34, and 35. Each of the pumps 32–35 requires its own electric motor, electric power, seal water, foundations, and requisite maintenance. The recirculations 25–28 also include a plurality of individual indirect heat exchangers 36, 37, 38, and 39 and corresponding spare heat exchangers. Typically high pressure steam is added to and condensate removed from each of the heat exchangers 36–39 via piping (not shown). Typically, spare heat exchangers (not shown) are also provided so that a primary heat exchanger 36–39 can be taken off-line and cleaned.

The conventional continuous digester 10 also typically includes several increases in diameter along its length, or "step outs", for example at 40, 41, 42, 43, and 44 (exaggerated in size in FIG. 1 for clarity of illustration). The step outs 40–44 are located in the vicinity of the screen assemblies 18–22 in order to provide a space for the chip slurry to expand into after liquor has been radially removed. The downward movement of the chip mass, or "chip column", is effected by the radial removal of the liquor through screens 18 through 24. Various compressive loads are introduced to the chip column by the column of slurry above, by the radial removal of liquor through the screens 18–22, and by the axial movement of liquor either up or down the chip column. This compression is particularly acute in the area adjacent the screens 18–22. The step outs 40–44 are proved to provide relief of the compression forces and to ensure the axial movement of the chip column.

The conventional digester 10 also includes zones in which the liquor in the slurry moves in a direction opposite the direction of movement of the chips or pulp. These "counter-current" treatment zones, for example, those illustrated by arrows 46 and 47 in FIG. 1, have been shown to provide an effective way to distribute cooking chemical and heat, and also provide displacement washing, such as HiHeat™ washing. However, the vertical final counter-current treatment zone 47 (in the lower half of digester 10, as seen in FIG. 1) typically limits the production rate that can pass through a treatment zone, while maintaining the required counter-current flow.

Thus conventional continuous digesters are typically tall and narrow (L/D 7–9 to 1). Multiple continuous vessels, positioned in series, are often used. These systems typically include a first pretreatment or impregnation vessel, and a second cooking vessel and the ancillary equipment and space required to support such multi-vessel systems.

Figure 2:
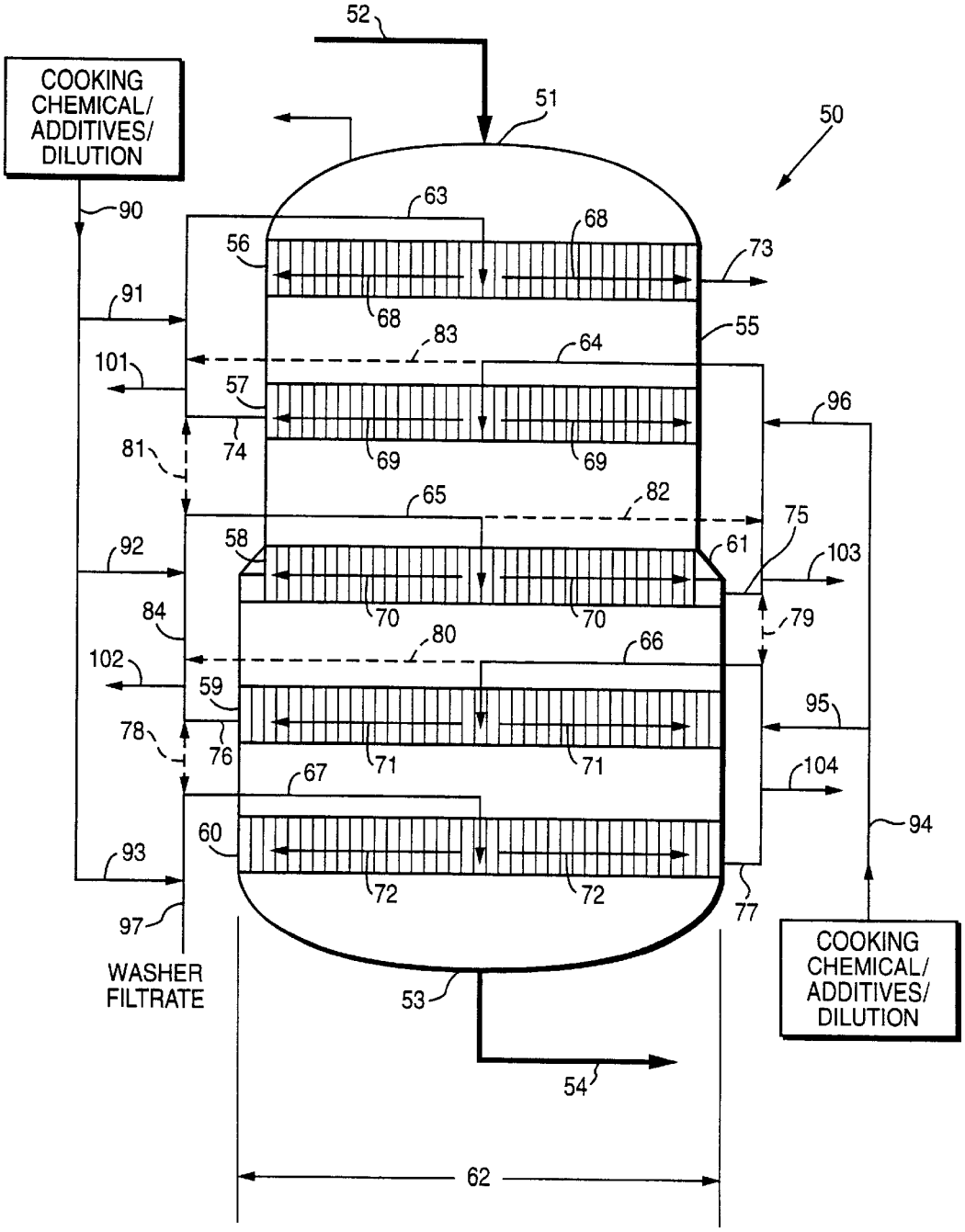
FIG. 2 is a schematic illustration of one embodiment of a continuous digester according to the present invention.

FIG. 2 schematically illustrates one embodiment of the present invention that addresses many of the limitations of the prior art system such as shown in FIG. 1. The digester system 50 of FIG. 2 includes an inlet 51 (adjacent the top) for slurry 52, an outlet 53 (adjacent the bottom) for pulp 54, and a substantially cylindrical vessel 55. Similar to the prior art digester vessel 15, the vessel 55 typically includes a plurality of vertically spaced liquor removal screens 56, 57, 58, 59 and 60. The vessel 15 may include one or more step-outs 61, but the vessel does not require such step-outs 61 (i.e. one or more or none may be provided). The screens 56–60 may also include converging internal shell geometry and no step-out as disclosed in patent application Ser. No. 08/936,047 filed on Sep. 23, 1997 now U.S. Pat. No. 5,985,096. This vessel may also include divergent screen assemblies as disclosed in application Ser. No. 08/953,880 filed on Oct. 24,1997 now U.S. Pat. No. 6,129,816.

However, the vessel 55 does not require any vertical countercurrent treatment zones; that is for example, no treatment zone such as at 47 in FIG. 1 is required in vessel 55, therefore treatment of the chips takes place substantially without interfering with the substantially continuous downward movement of the chips. One or more of the treatment zones in vessel 55 may be operated in a counter-current fashion, for example, toward the upper part of the vessel, and not interfere with the column movement, but not in substantially the lower half of vessel 55. Since the digester 50 of FIG. 2 is not limited by vertical counter-current flow considerations, the vessel 55 is not production limited. Also, the ratio of the length (height) of the vessel, L, to the maximum diameter of the vessel, D, may be at least 20%, typically 50%, greater than or less than the typical L/D ratio of conventional vessels (like the digester 10 of FIG. 1). For example, the UD of the vessel 55 can be less than 6 to 1 or greater than 10 to 1 and not be production limited. (For example, the L/D ratio of the embodiment shown in FIG. 2 is about 2 to 1.) According to the present invention, digester 55 may also have an L/D ratio within the range of 7–9 to 1, but not require countercurrent treatment.

The material introduced into digester 55 is treated with cooking liquors which are transferred mainly radially instead of primarily axially. That is, the material is treated by a "cross flow" of liquor, not a countercurrent flow. As shown in FIG. 2, cooking liquors may be introduced into the center of the vessel in the vicinity of the screen assemblies 56 through 60 by liquid introduction structures such as conduits 63, 64, 65, 66, and 67 (or other conventional equipment capable of such liquid introduction) and the liquor is drawn radially, as shown by arrows 68, 69, 70, 71, and 72, to the annular screens and removed via conduits 73, 74, 75, 76, and 77. (Though these conduits are shown as single conduits it is to be understood that they may comprise or consist of one or more conduits equally spaced about the circumference of the vessel 50. The conduits 73–77 may also be adjacent to each other and be associated with an annular screen assembly having an annular plenum and a septum between the conduits as shown in application Ser. No. 09/013,040 filed on Jan. 26, 1998 U.S. Pat. No. 6,120,647. Though in the schematic representation of FIG. 2 the liquor is shown flowing radially outwardly, it is to be understood that the liquor may also be introduced at the outer periphery of the vessel 50 and flow radially inwardly to a central removal location (e.g. screen assembly). In this way, the "counter-current" flow of liquid occurs outside the vessel 50 and not within the vessel 50.

The liquor removed by way of the conduits 73 through 77 may be recirculated and introduced back to the digester 50 by way of the conduits 63 through 67, or the liquor removed may be used elsewhere as desired, as indicated by alternative conduits 101–104 in FIG. 2. If the liquor is recirculated to the digester 50 it may be pressurized and heated by a centrifugal pump or an indirect heat exchanger which are not shown in FIG. 2, but are typically like the pumps 32 through 35 and heat exchangers 36 through 39 shown in FIG. 1. Liquor recirculated to the digester 50 by way of the conduits 63 through 67 may also be augmented with cooking liquor, via conduits 90–96, such as kraft white, green, or black liquor; or it may be augmented by liquor containing beneficial additives, such as strength or yield increasing additives, for example anthraquinone or polysulfide or their equivalents or derivatives. The recirculated liquor may also be augmented with a liquid containing a low concentration (½ or less of the concentration of the liquor removed from a screen) of dissolved organic material, such as washer filtrate, via conduits 90, 94, or 97, as is characteristic of the LO-SOLIDS pulping process.

In a preferred embodiment according to the invention, the liquor removed from a downstream screen assembly is recirculated, after appropriate liquor removal or addition as described above, to an upstream screen location. For example, in one preferred embodiment the downstream liquor is recirculated to the screen assembly immediately upstream of the screen assembly from which is was removed. As shown in FIG. 2, in this embodiment, liquor is removed from screen 60 by way of conduit 77 and recirculated to the vicinity of screen 59 by way of conduit 66 (which has an open end, or internal channels, or a perforated end, or other structure for introducing the recirculated liquor). Liquor introduced by conduit 66 passes radially outward to screen 59 and is removed by conduit 76. In turn, the liquor in conduit 76 is recirculated to the vicinity of screen 58 by way of conduits 84 and 65. This process may continue so that, in another embodiment of this invention, cellulose material is treated in essentially the entire digester 55 by a continuous, external counter-current, but cross-flow, treatment.

Figure 3:
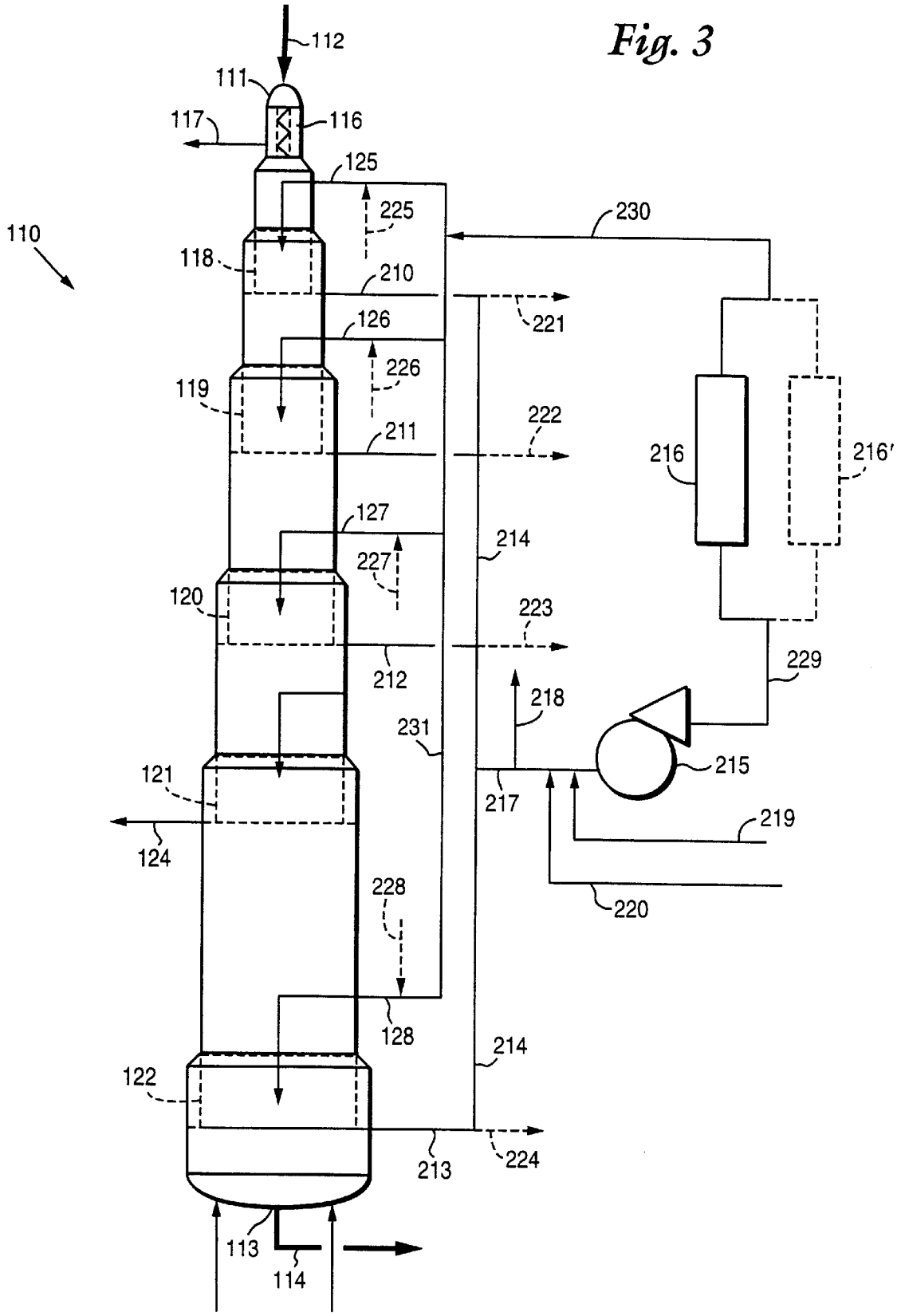
FIGS. 3 and 4 are schematic illustrations of other embodiments of a continuous digester according to the present invention.

The invention is not limited to the specific embodiment of FIG. 2. For example, the liquor may be removed from one screen assembly and may be reintroduced as needed to any upstream or downstream screen assembly. For example, some or all of the liquor removed from screen 60 may be recirculated to screen 57, or any other screen, via conduits 77, 79, and 64. In addition, liquor removed form screen 58 may be recirculated to screen 60 via conduits 75, 79, 66, 80, 84, 78, and 67. Other circulations, though not explicitly described, are also available by way of conduits 78, 79, 80,81, 82, and 83 shown in phantom in FIG. 2, and are within the skill of those in the art Another exemplary embodiment of the invention is shown substantially in FIG. 3. FIG. 3 illustrates a system 110 in which the number of pumps, heat exchangers, and other equipment, required to treat cellulose material to produce cellulose pulp is reduced compared to the conventional system of FIG. 1. The embodiment shown in FIG. 3 can also be used for the digester shown in FIG. 2. The digester 110 shown in FIG. 3 is in many ways similar to the digester 10 shown in FIG. 1. The items that appear in FIG. 3 that are very similar or identical to those that appear in FIG. 1 are identified by the same reference numeral but prefixed by the numeral "1".

As in the earlier drawings, the digester 110 of FIG. 3 includes several annular liquor removal screens 118,119, 120, 121, and 122. Liquor may be removed through screens 118–122 and the conduits 210, 211, 212, and 213, and processed or used elsewhere, for example, in the Heat and Chemical Recovery System, or the removed liquor may be recirculated to other locations in the digester 110. However, unlike the prior art systems employing a pump and heat exchanger for each of the circulations, according to the invention, two or more circulations are handled by fewer pumps, heat exchangers, and other equipment. As shown in FIG. 3, the present invention includes an embodiment in which the circulations are pressurized by a single pump 215 and a single heat exchanger 216. The liquor removed through the conduits 210 through 213 is combined into a single conduit 214 and fed via a single conduit 217 to the pump 215. Liquor may be removed as desired from the conduits 210–213, for example, via conduits 221, 222, 223, or 224, but liquor may also be removed via a single conduit 218. In addition, liquor may be added to the recirculation 217, for example, cooking liquor, or liquor containing additives, or dilution liquor as described earlier, as desired, may be added by conduits 225, 226, 227, or 228, but such liquors are preferably added via one or more conduits 219 and 220 at the inlet of the single pump 215. Typically a spare pump (not shown) similar to, and installed parallel to, pump 215 may also be provided.

Pump 215 preferably discharges pressurized liquor to the heat exchanger 216 by way of conduit 229. Typically, a spare heat exchanger 216' is also provided for use when the heat exchanger 216 is being cleaned or serviced. The liquor heated by heat exchanger 216 is returned via conduit 230 to common conduit 231, which provides pressurized, recirculated liquor to return conduits 125,126,127, and 128. In addition, instead of a single heat exchanger 216, a single pump 215 may be used to feed two or more heat exchangers. For instance, a single pump 215 may be used to pressurize several circulations and each circulation may include its own heat exchanger. For example, in FIG. 3, a single pump 215 may pressurize two or more liquors 212, 213, but the pressurized liquor may be heated by two or more heat exchangers located in conduits 127, 128.

The present invention also contemplates an embodiment in which two or more of the circulations are handled by a single pump and heat exchanger. In the broadest embodiment of the invention at least two circulations for a continuous digesters are handled by a single pump and other circulations are pressurized by one or more pumps. For example, in FIG. 1, the single pump, 215 of FIG. 3, may be used to pressurize the liquor removed from screens 19 and 20, and individual pumps 32, 35 may be used to pressurize the liquor recirculated from screens 18 and 22. Though not explicitly stated, other configurations and combinations of pumps and heat exchangers will be apparent to one skilled in the art, and are within the scope of the present invention.

Figure 4:
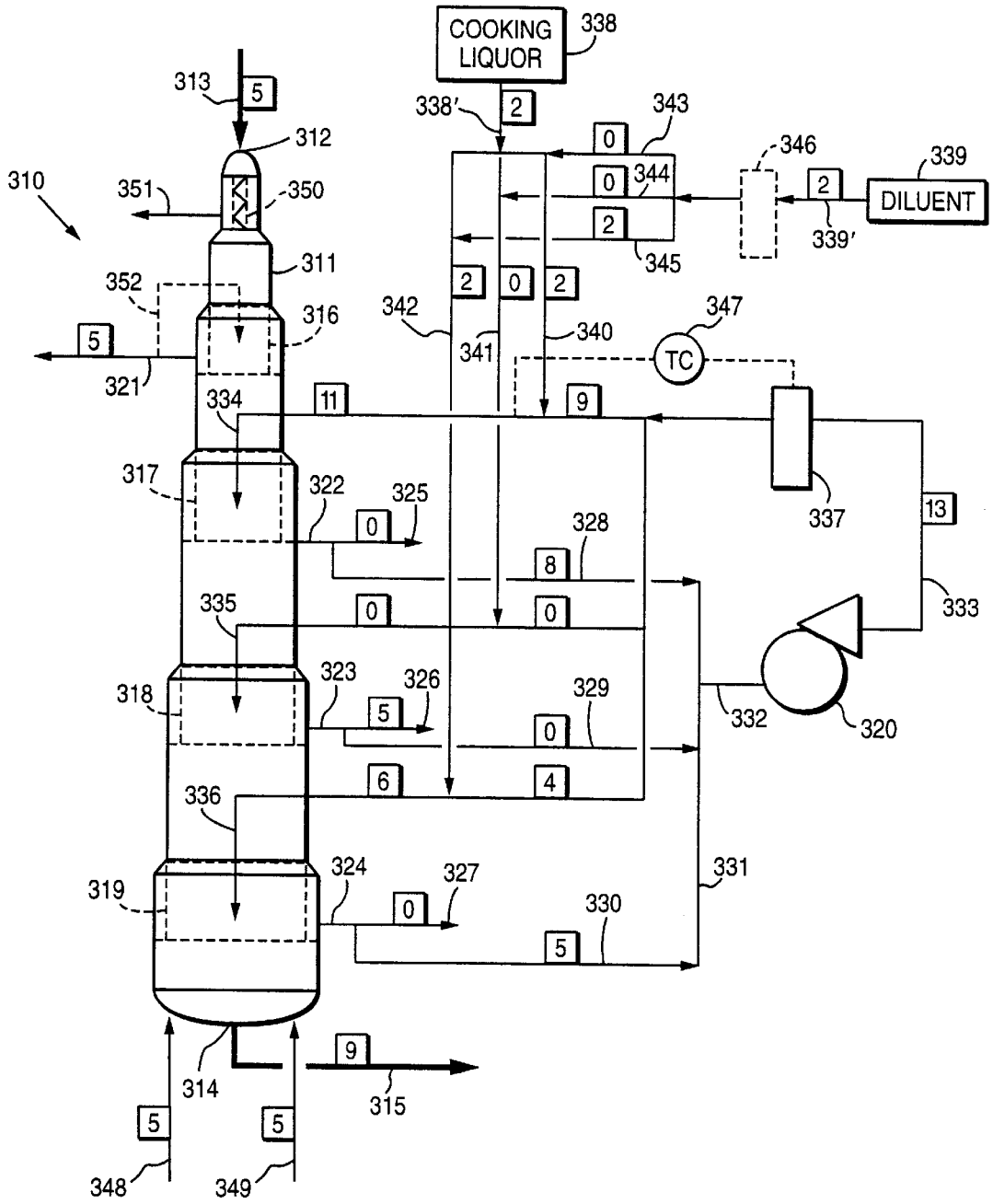

FIG. 4 illustrates another embodiment of the single-pump system shown in FIG. 3. The digester system 310 shown in FIG. 4 includes a vessel 311 having an inlet 312 for comminuted cellulosic fibrous material 313, an outlet 314 for essentially fully-cooked cellulose pulp 315 and four screen assemblies 316, 317, 318, and 319. Similar to system 110 of FIG. 3, system 310 includes a single pump 320 for pressurizing all the circulations associated with digester system 310. It is understood that though pump 320 handles all the circulation in the system shown in FIG. 4, the present invention includes the embodiment of at least two such circulations being pressurized by a single pump. Digester 311 also includes a liquor separating device 350, such as a Top Separator or Inverted Top Separator, for removing excess liquor from the slurry of liquor 313 introduced to the digester and returning it upstream, for example, to an impregnation vessel or to a feed system, via conduit 351.

Liquor is removed from the slurry passing through digester 311 by the annular screens and the respective conduits 321, 322, 323, and 324. This liquor may be removed from the digester system and used for other purposes or it may be re-circulated as need to the digester system 310 or associated cooking vessels, for example a conventional pretreatment or impregnation vessel (not shown). In FIG. 4, conduit 321 removes liquor from screen 316 and the liquor is forwarded, for example, to the chemical recovery operation. Conduit 321 may also have a recirculation 352 associated with it; the liquor in recirculation 352 may be recirculated and augmented with cooking or dilution liquors, for example, by means of pump 320, or by means of its own dedicated pump.

Conduits 322, 323 and 324 include both the option of removing liquor from the digester for other uses by conduits 325, 326, and 327, respectively, as described above for conduit 321, or the liquor removed from the vessel may be recirculated via conduits 328, 329, and 330, respectively. In the example shown in FIG. 4, conduits 328, 329, and 330 feed a common conduit 331 which feeds conduit 332 which directs liquor to the inlet of pump 320. The outlet of the pump is directed to conduit 333 which returns pressurized liquor to two or more conduits 334, 335, or 336 which re-introduce the liquor to the digester in the vicinity of screens 317, 318, and 319. As is conventional, conduits 334, 335, and 336 return liquor to the digester by a centrally located conduit or "centerpipe" mounted in digester 311 having apertures and baffles for introducing the liquor to the cellulose material.

The liquor recirculated through conduit 333 may be heated by an indirect steam heater 337. The flow of heating medium to the heat exchanger 337 may be regulated by temperature controller (TC) 347 which receives a temperature signal from a sensor located in, for example, conduit 334, and returns a control signal to the valve (not shown) controlling the flow of steam or other hot liquid to the heat exchanger 337. The liquor in conduits 333, 334, 335, and 336 may be augmented with cooking liquor from source 338, for example, kraft white, black, or green liquor or sulfite liquor, or liquor having yield or strength enhancing additives such as anthraquinone or polysulfide or there equivalents or derivatives. For example, cooking liquor from source 338 via conduit 338' may be introduced to conduit 334 by conduit 340; to conduit 335, by conduit 341; and to conduit 336, by conduit 342. The liquor in conduits 333, 334, 335, and 336 may also be augmented by the addition of diluent from source 339, for example, washer filtrate, evaporator condensate, fresh water, or any other low-dissolved-organic-material-containing liquid which is available in and around the pulp mill. For example, diluent from source 339 via conduit 339' may be introduced to conduit 334 by conduits 340 and 343; to conduit 335 by conduits 341 and 344; and to conduit 336 by conduits 342 and 345. Though FIG. 4 shows the diluent being added to the cooking liquor prior to introducing the liquor to the return conduits, the diluent may also be introduced directly to the return conduits. The diluent in conduit 339' may also be heated by an indirect heat exchanger 346. Heat may be supplied to this heat exchanger in the form of steam or hot liquid, for example, from one or more source of hot liquid removed from digester 311. The flow of liquid in conduits 338', 339', 340, 341, 342, 343, 344, and 345 is typically regulated and controlled by flow control valves (not shown), typically automated flow control valves, to introduce the cooking liquor and the diluent to conduits 334, 335 and 336, as desired.

Digester 311 also typically includes one or more conduits 348, 349 near the outlet of the vessel for introducing cooling dilution liquor to the essentially fully-cooked cellulose pulp prior to discharge of the pulp 315 from the vessel. This cooling, dilution liquor is typically downstream washer filtrate and is typically referred to as "cold blow" filtrate. This dilution liquor may come from the same source as diluent source 339.

FIG. 4 also includes one set of typical liquid volumes that may be handled by the conduits of digester system 310. These numbers, shown in boxes on the respective conduits, represent the volume of liquid present in the conduit in units of cubic meters per metric ton of pulp produced [$m^3$/T]. For example, the incoming cellulose material slurry 313 contains 5 $m^3$ of liquid per metric ton of cellulose pulp produced by digester system 310. (This 5 $m^3$/T liquor volume is the volume introduced to the digester after excess liquor is removed via conduit 351.) Similarly outgoing stream 315 contains 9 $m^3$/T of liquid. Other streams, for example, the liquid in conduit 333 from pump 320 contains 13 $m^3$/T, and conduit 338' from cooking liquor supply 338 contains 2 $m^3$/T of liquid. The flows shown in FIG. 4 are approximate.

Specifically, FIG. 4 shows the 5 $m^3$/T introduced to the digester via conduit 313 encounters 11 $m^3$/T introduced via circulation 334. 5 $m^3$/T is removed from the vessel via screen 316 and conduit 321. When the slurry reaches screen 317, 8 $m^3$/T are removed via conduit 328 for recirculation and no liquor is removed via conduit 325. In this example, no liquor is introduced to the slurry via recirculation conduit 335. Upon reaching screen 318, 5 $m^3/T$ are removed from the slurry via conduit 326 and removed from the system, for example, sent to recovery, and no liquor is recirculated via conduit 329. 6 $m^3/T$ of liquid is introduced to the slurry by recirculation conduit 336. Upon reaching screen 319, no liquor is removed via conduit 327 and 5 $m^3/T$ is removed and recirculated via conduit 330. In the lower part of the digester 10 $m^3/T$ is introduced to the slurry via conduits 348 and 349 and the pulp slurry is discharged from the vessel containing 9 $m^3/T$ of liquid. These introductions and removals are hydraulically balanced such that the net flow of liquid into and out of the vessel 311 is zero.

The liquid flows in FIG. 4 indicate one typical configuration for a single-pump system of the myriad of flow configurations that are within the skill in the art.

It will thus be seen that according to the present invention a highly advantageous method of treating wood chips or like comminuted cellulosic fibrous material, and an apparatus for practicing the method, have been provided which simplify and enhance the pulping operation while reducing capital costs. The number of apparatus components may be reduced, and the ability to uniformly treat the pulp, without "hang ups" enhanced.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. A method of treating comminuted cellulosic fibrous material in a substantially upright vessel having an upper half and a lower half, comprising substantially continuously:

(a) feeding a liquid slurry of comminuted cellulosic fibrous material into a top portion of the vessel;

(b) withdrawing treated comminuted cellulosic fibrous material from a bottom portion of the vessel, so that the comminuted cellulosic fibrous material moves substantially continuously downwardly in the vessel; and (c) in substantially the lower half of the vessel, causing treating liquid to flow substantially horizontally into and out of contact with the comminuted cellulosic fibrous material as the comminuted cellulosic fibrous material flows downwardly in the vessel, to effect treatment of the comminuted cellulosic fibrous material substantially without interfering with the substantially continuously downward movement of the comminuted cellulosic fibrous material, including by using cooking liquor as the treating liquid at at least one location in the lower half of the vessel.

2. A method as recited in claim 1 wherein (c) is practiced using a plurality of vertically spaced screen assemblies at peripheral portions of the vessel, and by introducing treating liquid into a central portion of the vessel at the approximate level of each screen assembly, and withdrawing the majority of the liquid introduced at the approximate level of any screen assembly through that screen assembly.

3. A method as recited in claim 2 wherein (c) is further practiced using cooking liquor as the treating liquid at at least one of the screen assemblies.

4. A method as recited in claim 3 wherein (c) is further practiced by recirculating liquid withdrawn from one screen assembly as introduced treating liquid at a central portion of another screen assembly.

5. A method as recited in claim 4 further comprising (d) augmenting the flow of liquid introduced at at least one location with a non-cooking liquor having a dissolved organic material concentration less than one-half that of the dissolved organic material concentration of the liquid existing in the vessel at that location.

6. A method as recited in claim 3 wherein (c) is further practiced by recirculating liquid withdrawn from one screen assembly as introduced treating liquid at a central portion of the immediately above screen assembly.

7. A method as recited in claim 3 further comprising (d) augmenting the flow of liquid introduced at at least one central portion with a non-cooking liquor having a dissolved organic material concentration less than one-half that of the dissolved organic material concentration of the liquid withdrawn through the screen assembly associated with that central portion.

8. A method as recited in claim 7 wherein (d) is practiced using washer filtrate.

9. A method as recited in claim 2 wherein (a)–(c) are practiced so that the vessel is substantially devoid of internal counter-current flow of materials and liquid in substantially the lower half of the vessel.

10. A method as recited in claim 2 wherein the vessel is substantially cylindrical and has an L/D ratio of 10 to 1 or more, or 6 to 1 or less, and wherein (c) is practiced by causing the treating liquid to flow substantially radially in the vessel.

11. A method as recited in claim 1 wherein the vessel is substantially cylindrical and has a length or height to width or diameter ratio of 10 to 1 or more, or 6 to 1 or less, and wherein (c) is practiced by causing the treating liquid to flow substantially radially in the vessel.

12. A method as recited in claim 11 wherein (c) is practiced at two or more vertically spaced locations along the substantially upright vessel.

13. A method as recited in claim 12 wherein (c) is practiced using a cooking liquor as the treatment liquid at at least one of the locations.

14. A method as recited in claim 13 further comprising (d) augmenting the flow of liquid introduced at at least one location with a non-cooking liquor having a dissolved organic material concentration less than one-half that of the dissolved organic material concentration of the liquid existing in the vessel at that location.

15. A method as recited in claim 13 wherein (c) is further practiced by recirculating radially flowing liquid at one location as introduction liquid at another location.

16. A method as recited in claim 15 wherein (c) is further practiced by recirculating radially flowing liquid at one location as introduction liquid at the immediately vertically above location.

17. A method as recited in claim 11 wherein (a)–(c) are practiced so that the vessel is substantially devoid of internal counter-current flow of materials and liquid in substantially the lower half of the vessel.

18. A method as recited in claim 1 wherein (a)–(c) are practiced so that the vessel is substantially devoid of internal counter-current flow of materials and liquid in substantially the lower half of the vessel.

* * * * *